US007809309B2

(12) United States Patent
Tomita et al.

(10) Patent No.: US 7,809,309 B2
(45) Date of Patent: Oct. 5, 2010

(54) PHOTOSENSITIVE-MEMBER DRIVING MECHANISM

(75) Inventors: Norio Tomita, Nara (JP); Yoshikazu Harada, Nara (JP); Tetsushi Ito, Nara (JP); Tetsuya Yamaguchi, Nara (JP); Yoshiteru Kikuchi, Nara (JP); Kenichi Isomi, Nara (JP); Showtaro Okamoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 206 days.

(21) Appl. No.: 12/127,090

(22) Filed: May 27, 2008

(65) Prior Publication Data

US 2008/0298841 A1 Dec. 4, 2008

(30) Foreign Application Priority Data

Jun. 1, 2007 (JP) ..... 2007-147130
Nov. 9, 2007 (JP) ..... 2007-292258

(51) Int. Cl.
*G03G 15/00* (2006.01)

(52) U.S. Cl. ..... 399/167

(58) Field of Classification Search ..... 399/167
See application file for complete search history.

(56) References Cited

U.S. PATENT DOCUMENTS 5,995,802 A 11/1999 Mori et al.
6,829,457 B2 * 12/2004 Ryuzaki et al. ..... 399/167

FOREIGN PATENT DOCUMENTS

| | | |
|---|---|---|
| JP | 07-261499 | 10/1995 |
| JP | 10-78734 | 3/1998 |
| JP | 2002-122188 | 4/2002 |
| JP | 2002-189383 | 7/2002 |
| JP | 2004-264525 | 9/2004 |
| JP | 2007-120609 | 5/2007 |

* cited by examiner

*Primary Examiner*—Hoang Ngo
(74) *Attorney, Agent, or Firm*—Renner, Otto, Boisselle & Sklar, LLP

(57) ABSTRACT

It is an object to prevent distortions and deviations of images caused by the eccentricity of a driven gear mounted to a rotational shaft of a photosensitive drum. There are provided a driving gear which is secured to a rotational shaft of a rotational driving power source and is rotated at a constant peripheral speed, a driven gear secured coaxially to a rotational shaft of a cylindrical-shaped photosensitive member, a phase control gear having the same diameter as that of the driven gear and having the same rotational speed variation characteristic as that of the driven gear, and a transmission gear, and a driving force from the driving gear is transmitted to the driven gear through the phase control gear and the transmission gear.

17 Claims, 8 Drawing Sheets

PHOTOSENSITIVE-MEMBER DRIVING MECHANISM

CROSS-REFERENCE TO RELATED APPLICATION

This application is related to Japanese Patent Applications No. 2007-147130 filed on Jun. 1, 2007 and No. 2007-292258 filed on Nov. 9, 2007, on the basis of which priorities are claimed under 35 USC §119, the disclosure of these applications being incorporated by reference in their entirety.

BACKGROUND OF THE INVENTION

1. Field of the Invention

The present invention mainly relates to a photosensitive-member driving mechanism employed in an image forming apparatus.

2. Description of the Related Art

As countermeasures against rotation variations (peripheral speed variations) of the photosensitive drums in conventional image forming apparatuses, there have been known first type systems for matching the phases of the rotation variations of plural photosensitive members for colored-image formation for reducing color shifts (refer to Japanese Unexamined Patent Publication No. Hei7(1995)-261499, for example) and second type systems for reducing the speed variations of photosensitive members through speed controlling of the motors for driving the photosensitive members (refer to Japanese Unexamined Patent Publication No. Hei10(1998)-78734, for example).

With the aforementioned first type systems, it is impossible to eliminate the distortions of images themselves and, even in cases of monochrome images, images formed on the photosensitive members are distorted in the direction of secondary scanning, which imposes a limit on the improvement of the image quality.

Further, in cases of image forming apparatuses including plural photosensitive members with different diameters, among color image forming apparatuses, color-shift adjustments can not be performed at all. Accordingly, in order to extend the life of the photosensitive member for black-color images and in order to increase the printing speed, if only the diameter of this photosensitive member is increased, this will make it impossible to eliminate color shifts.

With the aforementioned second type systems, there is a need for providing driving motors for controlling the speeds of the respective photosensitive drums and, further, there is a need for controlling the speeds thereof with higher accuracy, which has induced the problem of increase of the number of components of the apparatus and the necessity of complicated controlling.

SUMMARY OF THE INVENTION

According to the present invention, there is provided a photosensitive-member driving mechanism including a driving gear which is secured to a rotational shaft of a rotational driving power source and is rotated at a constant peripheral speed, a driven gear secured coaxially to a rotational shaft of a cylindrical-shaped photosensitive member, a phase control gear having the same diameter as that of the driven gear and having the same rotational speed variation characteristic as that of the driven gear, and a transmission gear, wherein the driving gear transmits a driving force to the driven gear through the phase control gear and the transmission gear.

Since the phase control gear has the same diameter as that of the driven gear and, also, has the same rotational speed variation characteristic as that of the driven gear, the variation of the peripheral speed of the photosensitive member due to the rotational speed variation characteristic of the driven gear is cancelled by the phase control gear, which causes the photosensitive member to rotate at a constant peripheral speed, thereby causing correct images with no distortions to be formed. Accordingly, even in cases of forming color images using plural photosensitive members, it is possible to form images with no color shifts.

DESCRIPTION OF THE PREFERRED EMBODIMENTS

Figure 1:
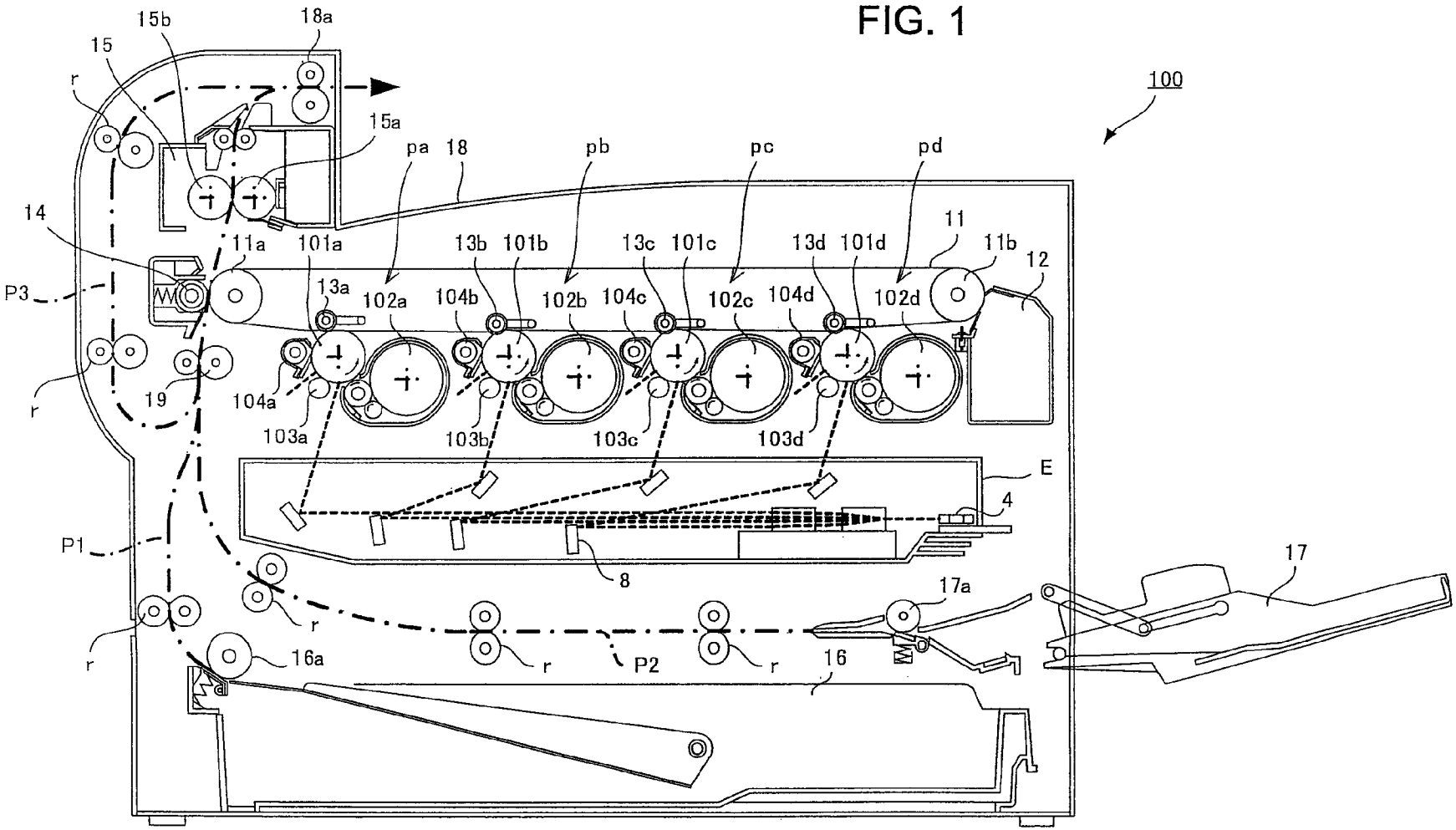
FIG. 1 is an explanation view of the structure of an image forming apparatus employing photosensitive-member driving mechanisms according to the present invention.

A first photosensitive-member driving mechanism according to the present invention includes a driving gear which is secured to a rotational shaft of a rotational driving power source and is rotated at a constant peripheral speed, a driven gear secured coaxially to a rotational shaft of a cylindrical-shaped photosensitive member, a phase control gear having the same diameter as that of the driven gear and having the same rotational speed variation characteristic as that of the driven gear, and a transmission gear, wherein the driving gear transmits a driving force to the driven gear through the phase control gear and the transmission gear.

The transmission gear may be adapted to transmit a peripheral speed of the phase control gear to the driven gear such that the driven gear is rotated at a constant angular speed.

The transmission gear may be detachably supported by a rotational shaft.

In the first photosensitive-member driving mechanism according to the present invention, the driven gear and the phase control gear are eccentric gears, and the driven gear and the phase control gear are provided with indexes indicative of the same rotational phase of both the gears, near the peripheral edges thereof. Assuming that a first straight line connecting the center of the driving gear and the center of the phase control gear and a second straight line connecting the center of the phase control gear and the index on the phase control gear form an angle of $\theta_A$ therebetween, a third straight line connecting the center of the phase control gear and the center of the transmission gear and the first straight line form an angle of $\theta_X$ therebetween, and a fourth straight line connecting the center of the transmission gear and the center of the driven gear and a fifth straight line connecting the center of the driven gear and the index on the driven gear form an angle of $\theta_B$ therebetween, it is preferable that there is the relationship of $\theta_X$=60 degrees and $\theta_B-(\theta_A-\theta_X)$=−60 degrees or $\theta_X$=−60 degrees and $\theta_B-(\theta_A-\theta_X)$=60 degrees (the characters of "±" indicate a direction of rotation of the driven gear and the opposite direction of rotation of the driven gear, respectively).

The indexes may be molded integrally with the driven gear and the phase control gear.

A second photosensitive-member driving mechanism according to the present invention includes a driving gear which is secured to a rotational shaft of a rotational driving power source and is rotated at a constant peripheral speed, driven gears being secured coaxially to respective rotational shafts of plural cylindrical-shaped photosensitive members and having the same diameter and the same rotational variation characteristic, a single phase control gear having the same diameter as that of the driven gears and having the same rotational speed variation characteristic as that of the driven gears, and plural transmission gears, wherein a driving force from the driving gear is transmitted to the respective driven gears through the phase control gear and the transmission gears.

A third photosensitive-member driving mechanism according to the present invention includes a first mechanism including a first driving gear which is secured to a rotational shaft of a rotational driving power source and is rotated at a constant peripheral speed, a first driven gear secured coaxially to a rotational shaft of a cylindrical-shaped photosensitive member, a first phase control gear having the same diameter as that of the first driven gear and having the same rotational speed variation characteristic as that of the first driven gear, and a first transmission gear, the first mechanism being adapted to transmit a driving force from the first driving gear to the first driven gear through the first phase control gear and the first transmission gear. Further, the third photosensitive-member driving mechanism further includes a second driving gear which is secured to a rotational shaft of a rotational driving power source and is rotated at a constant peripheral speed, second driven gears secured coaxially to respective rotational shafts of plural cylindrical-shaped photosensitive members and having the same diameter and the same rotational variation characteristic, a single second phase control gear having the same diameter as that of the second driven gears and having the same rotational speed variation characteristic as that of the second driven gears and plural second transmission gears, the second mechanism being adapted to transmit a driving force from the second driving gear to the respective second driven gears through the second phase control gear and the second transmission gears.

A fourth photosensitive-member driving mechanism according to the present invention includes a driving gear which is secured to a rotational shaft of a rotational driving power source and is rotated at a constant peripheral speed, a driven gear secured coaxially to a rotational shaft of a cylindrical-shaped photosensitive member, and a phase control gear having the same diameter as that of the driven gear and having the same rotational speed variation characteristic as that of the driven gear, wherein a driving force from the driving gear is transmitted to the driven gear through the phase control gear.

A fifth photosensitive-member driving mechanism according to the present invention includes a driving gear which is secured to a rotational shaft of a rotational driving power source and is rotated at a constant peripheral speed, plural driven gears secured coaxially to respective rotational shafts of cylindrical-shaped photosensitive members and having the same diameter and the same rotational variation characteristic, and a single phase control gear having the same diameter as that of the driven gears and having the same rotational speed variation characteristic as that of the driven gears, wherein a driving force from the driving gear is transmitted to the respective plural driven gears through the phase control gear.

In the fourth and fifth photosensitive-member driving mechanisms according to the present invention, the driven gear(s) and the phase control gear are eccentric gears, and the driven gear(s) and the phase control gear are provided with indexes indicative of the same rotational phase of both the gears. Assuming that a first straight line connecting the center of the driving gear and the center of the phase control gear and a second straight line connecting the center of the phase control gear and the index on the phase control gear form an angle of $\theta_A$ therebetween, a third straight line connecting the center of the phase control gear and the center of the driven gear and the first straight line form an angle of $\theta_X$ therebetween, and a fourth straight line connecting the center of the driven gear and the index on the driven gear and the third straight line form an angle of $\theta_B$ therebetween, it is preferable that there is the relationship of $\theta_X$=60 degrees and $\theta_B-(\theta_A-\theta_X)$=−60 degrees or $\theta_X$=−60 degrees and $\theta_B-(\theta_A-\theta_X)$=60 degrees (the characters of "±" indicate a direction of rotation of the driven gear and the opposite direction of rotation of the driven gear, respectively).

In the fourth and fifth photosensitive-member driving mechanisms according to the present invention, the driven gear(s) can include a first and second driven gears, and there is provided a transmission gear for transmitting the driving force from the first driven gear to the second driven gear.

It is preferable that the transmission gear is a gear having the same eccentricity characteristic as that of the driven gear (s).

The rotational phase of the transmission gear can be set, such that indexes on the first driven gear and the transmission gear can be coincident with the contact point between the first driven gear and the transmission gear, and indexes on the second driven gear and the transmission gear can be coincident with the contact point between the second driven gear and the transmission gear.

Hereinafter, the present invention will be described, on the basis of embodiments illustrated in the drawings.

FIG. 1 is a structural explanation view illustrating the structure of an image forming apparatus employing photosensitive-member driving mechanisms according to the present invention. An image forming apparatus 100 forms multicolored images and monochrome images on recording mediums such as paper sheets, in response to image data received from the outside. Therefore, the image forming apparatus 100 includes an exposure unit E, photosensitive drums 101*a* to 101*d* with the same diameter (cylindrical-shaped photosensitive members), development units 102*a* to 102*d*, charging rollers 103*a* to 103*d*, cleaning units 104*a* to 104*d*, an intermediate transfer belt 11, intermediate transfer rollers 13*a* to 13*d*, a secondary transfer roller 14, a fixing device 15, sheet transfer paths P1, P2 and P3, a sheet feeding cassette 16, a manual sheet feeding tray 17 and a sheet ejection tray 18, and the like.

The image forming apparatus 100 forms images using image data corresponding to respective color phases, wherein the color phases correspond to four colors constituted by black (K) and three fundamental colors of cyan (C), magenta (M) and yellow (Y) according to subtractive color mixture resulted from color separation. The numbers of the photosensitive drums 101*a* to 101*d*, the development units 102*a* to 102*d*, the charging rollers 103*a* to 103*d*, the transfer rollers 13*a* to 13*d*, and the cleaning units 104*a* to 104*d* are four, in association with the respective color phases, thereby forming four image forming portions Pa to Pd. The image forming portions Pa to Pd are arranged in series in the direction of the movement of the intermediate transfer belt 11 (the direction of secondary scanning).

The charging rollers 103 are contact-type charging devices which uniformly charge the surfaces of the photosensitive drums 101 at a predetermined electric potential. The exposure unit E includes a semiconductor laser which is not illustrated, a polygon mirror 4 and a reflection mirror 8 and the like and directs respective laser beams modulated by image data corresponding to the respective color phases of black, cyan, magenta and yellow to the respective photosensitive drums 101*a* to 101*d* to form latent images corresponding to the image data on the surfaces of the photosensitive drums 101*a* to 101*d*. On the photosensitive drums 101*a* to 101*d*, latent images are formed from the image data corresponding to the respective color phases of black, cyan, magenta and yellow.

Accordingly, the photosensitive drum 101*a* is an image carrying member on which black toner images are formed during formation of monochrome images, while the photosensitive drum 101*b* to 101*d* are image carrying members on which toner images in three fundamental colors according to subtractive color mixture are formed during formation of full-colored images.

The development units 102*a* to 102*d* supply development agents to the surfaces of the photosensitive drums 101*a* to 101*d* on which latent images have been formed, to elicit the latent images into toner images. The respective development units 102*a* to 102*d* house the development agents corresponding to the respective color phases of black, cyan, magenta and yellow and elicit the latent images corresponding to the respective color phases formed on the photosensitive drums 101*a* to 101*d* into toner images corresponding to the respective color phases of black, cyan, magenta and yellow. The cleaning units 104*a* to 104*d* remove and collect toners residue on the surfaces of the photosensitive drums 101*a* to 101*d* after development and image transferring.

The intermediate transfer belt 11 placed above the photosensitive drums 101*a* to 101*d* is stringed between a driving roller 11*a* and a driven roller 11*b* to form a loop-shaped movement path. The outer peripheral surface of the intermediate transfer belt 11 is faced to the photosensitive drum 101*d*, the photosensitive drum 101*c*, the photosensitive drum 101*b* and the photosensitive drum 101*a*, in the mentioned order.

The transfer rollers 13*a* to 13*d* are placed at positions facing to the respective photosensitive drums 101*a* to 101*d* across the intermediate transfer belt 11. A transferring bias with the opposite polarity from the polarity of charges on the toners is applied to the transfer rollers 13*a* to 13*d*, in order to transfer the toner images carried on the surfaces of the photosensitive drums 101*a* to 101*d* to the intermediate transfer belt 11. Accordingly, the toner images corresponding to the respective color phases formed on the photosensitive drums 101*a* to 101*d* are transferred, in order, to the outer peripheral surface of the intermediate transfer belt 11 such that they are superimposed thereon, thereby causing full-colored toner images to be formed on the outer peripheral surface of the intermediate transfer belt 11.

However, in cases where image data about only some of the color phases of cyan, magenta, yellow and black is inputted, latent images and toner images are formed on only the photosensitive drums corresponding to the color phases of the inputted image data, out of the four photosensitive drums 101*a* to 101*d*. For example, during formation of monochrome images, latent images and toner images are formed only on the photosensitive drum 101*a* corresponding to the black color phase, and only black toner images are transferred to the outer peripheral surface of the intermediate transfer belt 11.

Each of the transfer rollers 13*a* to 13*d* is formed from a shaft made of a metal (for example, a stainless steel) with a diameter in the range of 8 to 10 mm and a conductive elastic member (for example, EPDM, foamed urethane) covering the surface of the shaft, and a high voltage is uniformly applied to the intermediate transfer belt 11 through the conductive elastic member. Instead of such transfer rollers, it is possible to employ brush-type intermediate transfer members.

The toner images formed on the outer peripheral surface of the intermediate transfer belt 11 as described above are transferred to the position faced to the secondary transfer roller 14, through the rotation of the intermediate transfer belt 11. During image formation, the secondary transfer roller 14 is kept in contact with the outer peripheral surface of the intermediate transfer belt 11 at a predetermined nipping pressure. When a paper sheet fed from the sheet cassette 16 or the manual sheet feeding tray 17 passes between the secondary transfer belt 14 and the intermediate transfer belt 11, a high voltage with the opposite polarity from the polarity of the charges on the toners is applied to the secondary transfer roller 14. Thus, the toner images are transferred to the surface of the paper sheet from the outer peripheral surface of the intermediate transfer belt 11.

Further, in order to maintain the nipping pressure between the secondary transfer roller 14 and the intermediate transfer belt 11 at a predetermined value, any one of the secondary transfer roller 14 and the driving roller 11*a* is formed from a hard material (such as metal), while the other one of them is formed from a soft material such as an elastic roller (for example, an elastic rubber roller or a foamed-resin roller).

Further, the toners residue on the intermediate transfer belt 11 which was not transferred to the paper sheet, out of the toners adhered to the intermediate transfer belt 11 from the photosensitive drums 101*a* to 101*d*, are collected by the cleaning units 12, in order to prevent the occurrence of color mixture in the subsequent processes.

The paper sheet to which toner images have been transferred is directed to the fixing device 15 and is passed between a heating roller 15*a* and a pressing roller 15*b* to be heated and pressed thereby. Consequently, the toner images are firmly fixed to the surface of the paper sheet. The paper sheet on which the toner images have been fixed is ejected to the sheet ejection tray 18 through a sheet ejection roller 18*a*.

The image forming apparatus 100 is provided with the sheet transfer path P1 substantially in the vertical direction for feeding paper sheets housed in the sheet cassette 16 to the sheet ejection tray 18 through between the secondary transfer roller 14 and the intermediate transfer belt 11 and through the fixing device 15. Along the sheet transfer path P1, there are placed a pickup roller 16*a* for bringing up paper sheets within the sheet cassette 16 into the sheet transfer path P1 one by one, a transfer roller r for upwardly transferring the paper sheets which have been brought up, a resist roller 19 for directing the paper sheets transferred thereto to between the secondary transfer roller 14 and the intermediate transfer belt 11 at predetermined timing, and the sheet ejection roller 18*a* for ejecting the paper sheets onto the sheet ejection tray 18.

Further, inside of the image forming apparatus 100, there is formed the sheet transfer path P2 along which a pickup roller 17*a* and the transfer roller r are placed, between the manual sheet feeding tray 17 and the resist roller 19. Further, there is formed the sheet transfer path P3, between the sheet ejection roller 18*a* and the side of the sheet transfer path P1 upstream from the resist roller 19.

The sheet ejection roller 18*a* is made rotatable in both a normal direction and the opposite direction and is driven in the direction of normal rotation to eject paper sheets onto the sheet ejection tray 18, during one-side image formation for forming images on one surfaces of paper sheets and during second-side image formation in double-side image formation for forming images on the both sides of paper sheets. On the other hand, during first-side image formation in double-side image formation, the ejection roller 18*a* is driven in the direction of normal rotation until the rear end of a paper sheet passes through the fixing device 15 and, thereafter, is driven in the direction of reverse rotation to direct the paper sheet to the sheet transfer path P3 while holding the rear end portion of the paper sheet. Thus, during double-side image formation, the paper sheet which has been subjected to image formation on its one side is directed to the sheet transfer path P1 at a state where its front and rear surfaces and its front and rear ends are reversed.

The resist roller 19 directs paper sheets fed from the sheet cassette 16 or the manual sheet feeding tray 17 or paper sheets transferred through the sheet transfer path P3 to between the secondary transfer roller 14 and the intermediate transfer belt 11 at timing synchronized with the rotation of the intermediate transfer belt 11. Accordingly, the resist roller 19 is stopped rotating at the start of the operations of the photosensitive drums 101 and the intermediate transfer belt 11, and a paper sheet fed or transferred prior to the rotation of the intermediate transfer belt 11 is stopped moving along the sheet transfer path P1 at a state where its front end is kept in contact with the resist roller 19. Thereafter, the resist roller 19 starts rotating at such timing that the front end portion of the paper sheet and the front end portion of the toner image formed on the intermediate transfer belt 11 are faced to each other, at the position where the secondary transfer roller 14 and the intermediate transfer belt 11 are contacted with each other in such a way as to press each other.

FIRST EXAMPLE

Figure 2:
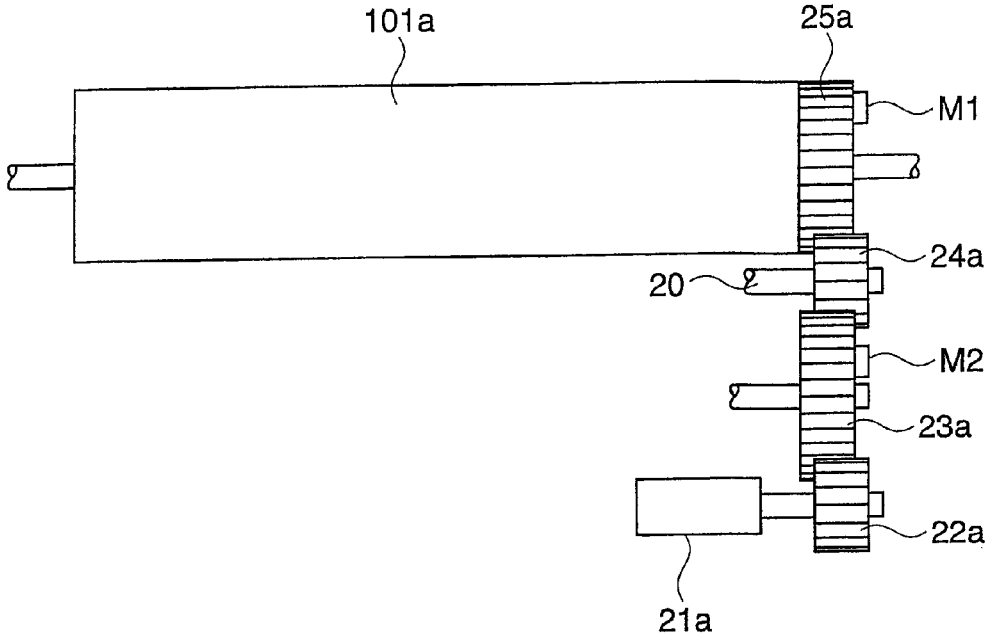
FIG. 2 is a side view illustrating a first example of the photosensitive-member driving mechanism according to the present invention.
Figure 3:
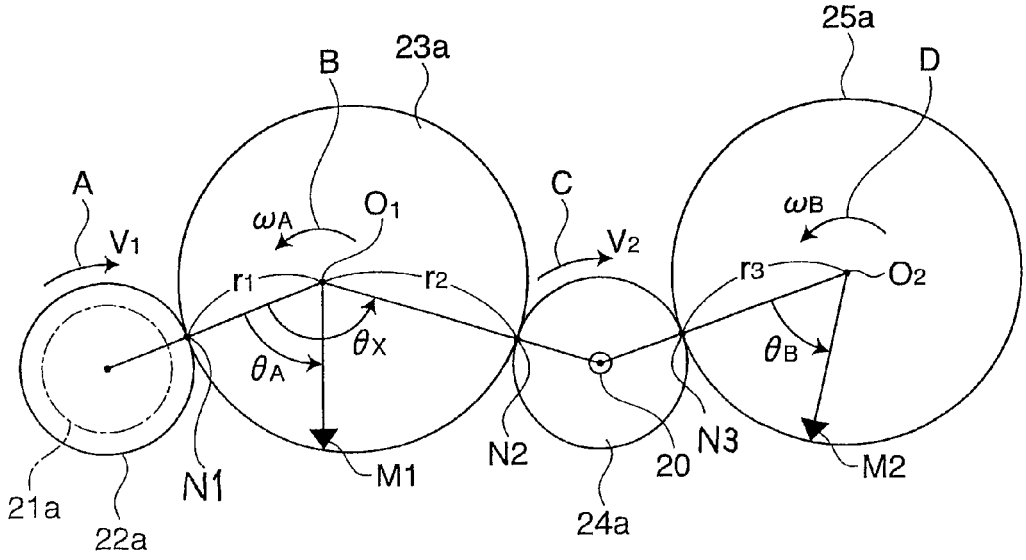
FIG. 3 is a front view illustrating the first example of the photosensitive-member driving mechanism according to the present invention.

FIG. 2 is a side view illustrating a first example of a photosensitive-member driving mechanism applied to the image forming apparatus of FIG. 1, and FIG. 3 is a front view of the first example. In these figures, a driving gear 22*a* is driven by a motor 2 la as a rotation driving source and is rotated in the direction of an arrow A at a constant peripheral speed of V1.

A driven gear 25*a* is a gear which is coupled to an end portion of the photosensitive drum 101*a* and rotates the drum 101*a* in the direction of an arrow D at a photosensitive-member angular speed $\omega_B$. While there will be described only the driving mechanism for the photosensitive drum 101*a* hereinafter, the photosensitive drums 101*b* to 101*d* illustrated in FIG. 1 also have the same driving mechanism.

A phase control gear 23*a* is a gear having the same speed variation characteristic as that of the driven gear 25*a* and is formed using the same die as that for the driven gear 25*a*. The speed variation characteristic is mainly caused by the eccentricity of the gear, and gears formed using the same die will have the same eccentricity characteristic.

The driving gear 22*a* is contacted with the phase control gear 23*a* and transmits a driving force thereto. The driving force from the phase control gear 23*a* is transmitted to the driven gear 25*a* through a transmission gear 24*a*. The phase control gear 23*a* is rotated in the direction of an arrow B at an angular speed of $\omega_A$, and the transmission gear 24*a* is rotated in the direction of an arrow C at a peripheral speed of V2.

The phase control gear 23*a* and the driven gear 25*a* in FIG. 3 are provided with triangular marks M1 and M2, which are formed from protruding portions (see FIG. 2) formed during the integral formation of the respective gears and used as indexes indicative of the same rotational phase of both the gears (hereinafter, the triangular marks will be referred to as indexes).

Accordingly, the indexes M1 and M2 enable visually recognizing the rotational phase of the phase control gear 23*a* and the driven gear 25*a*. In the present invention, adjustments are performed by visually recognizing the positions of the indexes M1 and M2 during assembling of the driving mechanism. The transmission gear 24*a* is detachably supported by a rotational shaft 20 and, therefore, the phase control gear 23*a* and the driven gear 25*a* are manually rotated to determine their respective rotational phases at a state where the transmission gear 24*a* is disengaged therefrom and, thereafter, the transmission gear 24*a* is mounted to the rotational shaft 20.

The photosensitive-member driving mechanism according to the present invention includes the driving gear 22*a* which rotates at a constant peripheral speed, the driven gear 25*a* secured to an end portion of the photosensitive drum 101*a*, the phase control gear 23*a* having the same speed variation characteristic as that of the driven gear 25*a*, and the transmission gear 24*a* which transmits the rotation of the phase control gear 23*a* to the driven gear 25*a* such that the driven gear 25*a* is rotated at a constant angular speed. With this structure, it is possible to maintain, finally, the peripheral speed of the photosensitive drum 101*a* at a constant speed to reduce the deviation of the laser writing position with respect to the photosensitive drum 101*a* and the deviation of the transferring position at which toner images are transferred from the photosensitive drum 101*a* to the intermediate transfer belt 11 (FIG. 1), thereby finally reducing the deviation of the image forming position.

There will be further described the structure and the functions of the photosensitive-member driving mechanisms according to the present invention.

As illustrated in FIG. 3, it is assumed that the peripheral speed of the driving gear 22*a* is V1, the radius from the contact point N1 between the phase control gear 23*a* and the driving gear 22*a* to the rotational center $\mathbf{0}_1$ is $r_1$, the radius from the contact point N2 between the phase control gear 23*a* and the transmission gear 24*a* to the rotational center $\mathbf{0}_1$ is $r_2$, and the radius from the contact point N3 between the driven gear 25*a* and the transmission gear 24*a* to the rotational center $\mathbf{0}_2$ is $r_3$.

Further, it is assumed that the angular speeds of the phase control gear 23*a* and the driven gear 25*a* are $\omega_A$ and $\omega_B$, respectively, the straight line connecting the center $\mathbf{0}_1$ and the point N1 and the straight line connecting the center $\mathbf{0}_1$ and the index M1 form an angle of $\theta_A$ therebetween, the straight line connecting the center $\mathbf{0}_1$ and the point N1 and the straight line connecting the center $\mathbf{0}_1$ and the point N2 form an angle of $\theta_X$ therebetween, and the straight line connecting the center $\mathbf{0}_2$ and the point N3 and the straight line connecting the center $\mathbf{0}_2$ and the index M2 form an angle of $\theta_B$ therebetween.

v1 is the peripheral speed of the driving motor, which is constant. Further, assuming that r is the designed radius of the phase control gear 23*a* and the driven gear 25*a*, r1, r2 and r3 are periodically-varying values as will be described later, due to the eccentricities of the phase control gear 23*a* and the driven gear 25*a*.

$$r1=r+ra\sin\theta_A,\ r2=r+ra\sin(\theta_A-\theta_X),\ r_3=r+ra\sin\theta_B$$

In this case, a is the ratio of the varying portion of r1, r2 and r3 caused by the periodic variation thereof relative to r.

Therefore, the angular speed $\omega_A$ of the phase control gear 23*a* is expressed as follows.

$$\omega_A=v_1/r_1=v_1/(r+ra\sin\theta_A)=(v_1/r)/(1+a\sin\theta_A)=(v_1/r)\cdot(1-a\sin\theta_A)/(1-a^2\sin\theta_A)$$

Since the inequality a<<1 holds, the equation $a^2=0$ holds. Accordingly, the following equation holds.

$$\omega_A=(v_1/r)(1-a\sin\theta_A) \tag{1}$$

Next, the peripheral speed $v_2$ of the transmission gear 24*a* is expressed as follows.

$$v_2=r_2\omega_A=v_1\{1-a\sin\theta_A+a\sin(\theta_A-\theta_X)\} \tag{2}$$

Next, the angular speed $\omega_B$ of the driven gear 25*a* is expressed as follows.

$$\omega_B=v_2/r_3=(v_1/r)\{1-a\sin\theta_A+a\sin(\theta_A-\theta_X)-a\sin\theta_B\} \tag{3}$$

From the above description, the varying portions $\Delta\omega_A$ and $\Delta\omega_B$ of the angular speeds $\omega_A$ and $\omega_B$ are expressed as follows.

$$\Delta\omega_A=-a\sin\theta_A$$

$$\Delta\omega_B=-a\sin\theta_A+a\sin(\theta_A-\theta_X)-a\sin\theta_B$$

Hereinafter, the condition for satisfying the relationship of $\Delta\omega_B=0$ will be determined. This condition is a condition which can make the variation of the angular speed $\omega_B$ of the driven gear 25*a* to be zero, thereby making the variation of the peripheral speed of the photosensitive drum 101*a* to be zero.

In order to satisfy the relationship of $\Delta\omega_B=0$, "X" satisfying such a condition of $\theta_X$, $\theta_A$ and $\theta_B$ as to cause the equation (3) to satisfy the following equation (4) is determined, and the condition for satisfying the relationship of X=0 is determined.

$$\omega_B=(v_1/r)\{1-X\sin\theta_B\} \tag{4}$$

At first, it has been proven that, in the case where the following equation (5) holds, the equation (4) can be satisfied.

$$\theta_X=2\theta_A-2\theta_B-180 \tag{5}$$

Therefore, the equation (5) is substituted into the equation (3) to provide the following equation.

$$\begin{aligned}\omega_B &= (v_1/r)\cdot[1-a\sin\theta_A+ \\ &\quad a\sin\{\theta_A-(2\theta_A-2\theta_B-180)\}-a\sin\theta_B] \\ &= (v_1/r)\cdot[1-\{a+2a\cos(\theta_A-\theta_B)\}\sin\theta_B] \\ &= (v_1/r)\cdot[1-\{a+2a\cos(\theta_X-(\theta_B-(\theta_A-\theta_X)))\}\sin\theta_B]\end{aligned} \tag{6}$$

In the equation (6), $\theta_B-(\theta_A-\theta_X)$ means the value of $\theta_B$ in the case of $\theta_A=\theta_X$, namely the positional relationship between the phase control gear 23 and the driven gear 25.

Accordingly, the condition which can satisfy the equation X=0 is as follows.

$$X=a+2a\cos(\theta_X-(\theta_B-(\theta_A-\theta_X)))=0$$

Namely, when the equation of $\cos(\theta_X-(\theta_B-(\theta_A-\theta_X)))=-0.5$ holds, the equation X=0 holds.

The conditions of $\theta_X$, $\theta_A$, and $\theta_B$ which satisfy the aforementioned equation are expressed as follows.

$$\theta_X-(\theta_B-(\theta_A-\theta_X))=\pm120^\circ \tag{7}$$

and $$\theta_X=2\theta_A-2\theta_B-180^\circ \tag{5}$$

The concrete numerical values which satisfy the equation (7) and the aforementioned equation (5) are as follows.

$$\theta_X=60^\circ,\ \text{and}\ \theta_B-(\theta_A-\theta_X)=-60^\circ$$

or $$\theta_X=-60^\circ,\ \text{and}\ \theta_B-(\theta_A-\theta_X)=60^\circ$$

Figure 4:
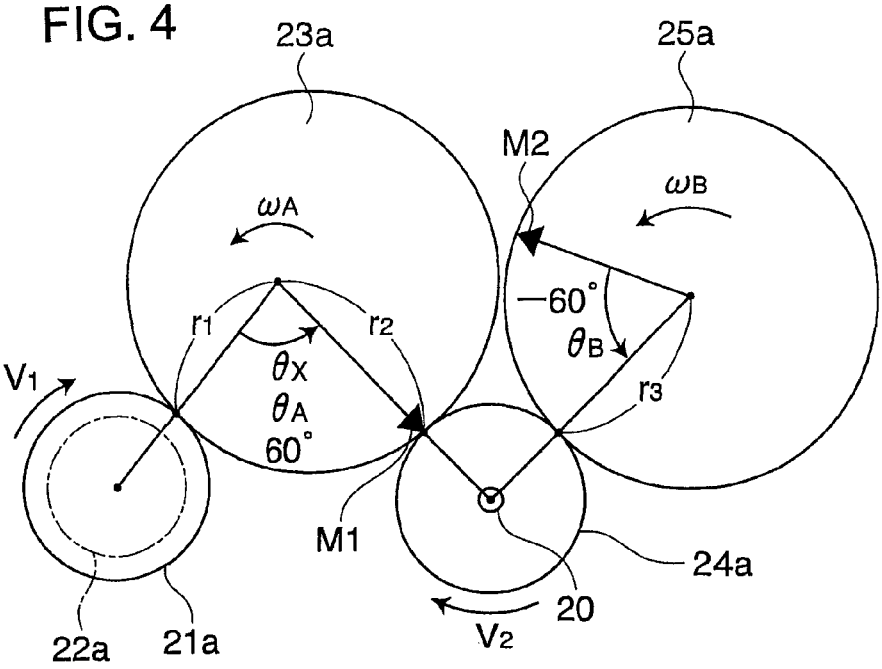
FIG. 4 is a front view illustrating an exemplary arrangement of the first example of the photosensitive-member driving mechanism according to the present invention.

FIG. 4 illustrates a concrete example of the photosensitive-member driving mechanism in the case of $\theta_X=60^\circ$ and $\theta_B-(\theta_A-\theta_X)=-60^\circ$ and $\theta_X=\theta_A$, which is one of the conditions which satisfy the equation $\Delta\omega_B=0$.

As illustrated in FIG. 4, by setting the positions of the indexes M1 and M2 on the respective gears, it is possible to make the varying portion $\Delta\omega_B$ of the angular speed of the driven gear 25*a* to be zero, thereby rotating the photosensitive drum 101*a* at a constant angular speed (at a constant peripheral speed).

SECOND EXAMPLE

In the present example, there will be described the photosensitive-member driving mechanisms which are integrally applied to the photosensitive drums 101*b* to 101*d* for forming full-colored images in the image forming apparatus 100 illustrated in FIG. 1.

Further, the photosensitive-member driving mechanism according to the first example is applied to the photosensitive drum 101*a* for forming black-colored images. In this case, the photosensitive drum 101*a* can have a diameter larger than that of the other photosensitive drums 101*b* to 101*d*.

FIGS. 5 to 8 illustrate the positional and angular relationship among the respective components of the photosensitive-member driving mechanisms according to the present example.

Figure 5:
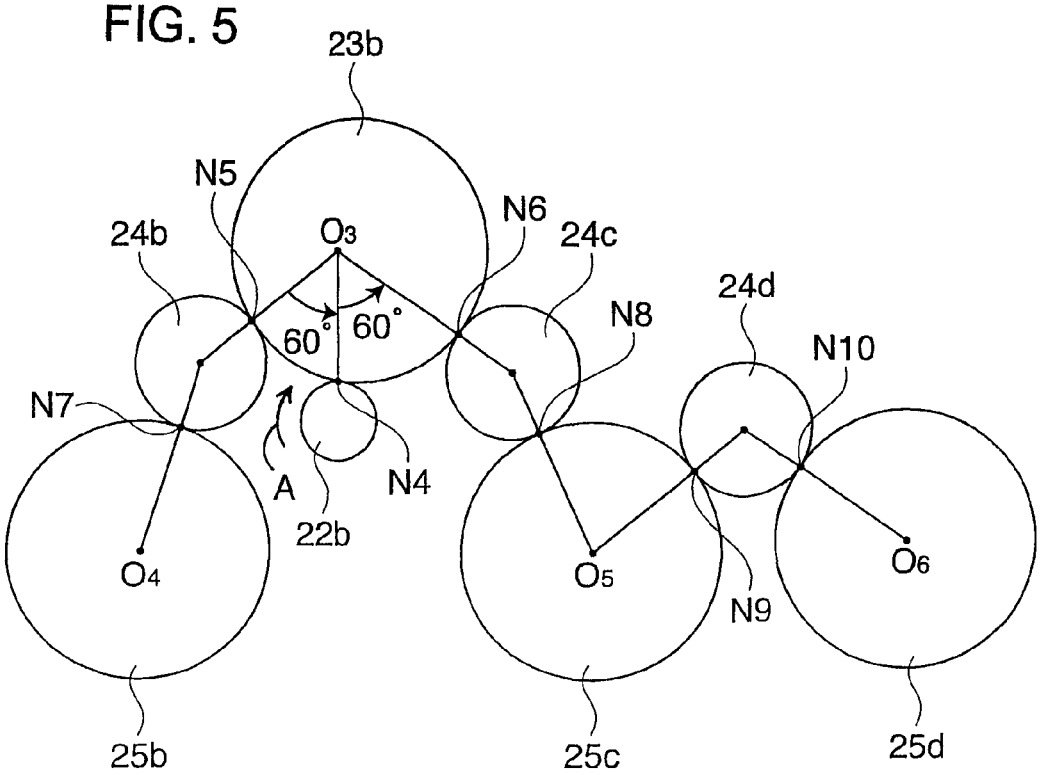
FIG. 5 is a front view illustrating an exemplary arrangement of a second example of the photosensitive-member driving mechanism according to the present invention.

As illustrated in FIG. 5, the rotational force from a driving gear 22*b* which is driven at a constant speed in the direction of an arrow A by a motor, not illustrated, is transmitted to a phase control gear 23*b* and, then, the rotational force is transmitted from the phase control gear 23*b* to a driven gear 25*b* through a transmission gear 24*b*, also is transmitted to a driven gear 25*c* through a transmission gear 24*c* and, then, is transmitted from the driven gear 25*c* to a driven gear 25*d* through a transmission gear 24*d*. The driven gears 25*b* to 25*d* are coupled to end portions of the photosensitive drums 101*b* to 101*d*, respectively. Further, the driven gears 25*b* to 25*d* and the phase control gear 23*b* are formed using the same die and have the same speed variation characteristic.

Further, the phase control gear 23*b* has a rotational center $\mathbf{0}_3$ and is contacted with the driving gear 22*b* and the transmission gears 24*b* and 24*c* at points N4, N5 and N6, respectively, while the driven gear 25*b* has a rotational center $\mathbf{0}_4$ and is contacted with the transmission gear 24*b* at a point N7. The driven gear 25*c* has a rotational center $\mathbf{0}_5$ and is contacted with the transmission gears 24*c* and 24*d* at points N8 and N9. The driven gear 25*d* has a rotational center $\mathbf{0}_6$ and is contacted with the transmission gear 24*d* at a point N10.

Further, as illustrated in FIG. 5, similarly to the example illustrated in FIG. 4, the straight line connecting the rotational center $\mathbf{0}_3$ of the phase control gear 23*b* and the point N4 and the straight line connecting the rotational center $\mathbf{0}_3$ thereof and the point N5 form an angle of 60° therebetween. Further, the straight line connecting the rotational center $\mathbf{0}_3$ and the point N4 and the straight line connecting the rotational center $\mathbf{0}_3$ and the point N6 form an angle of 60° therebetween.

Figure 6:
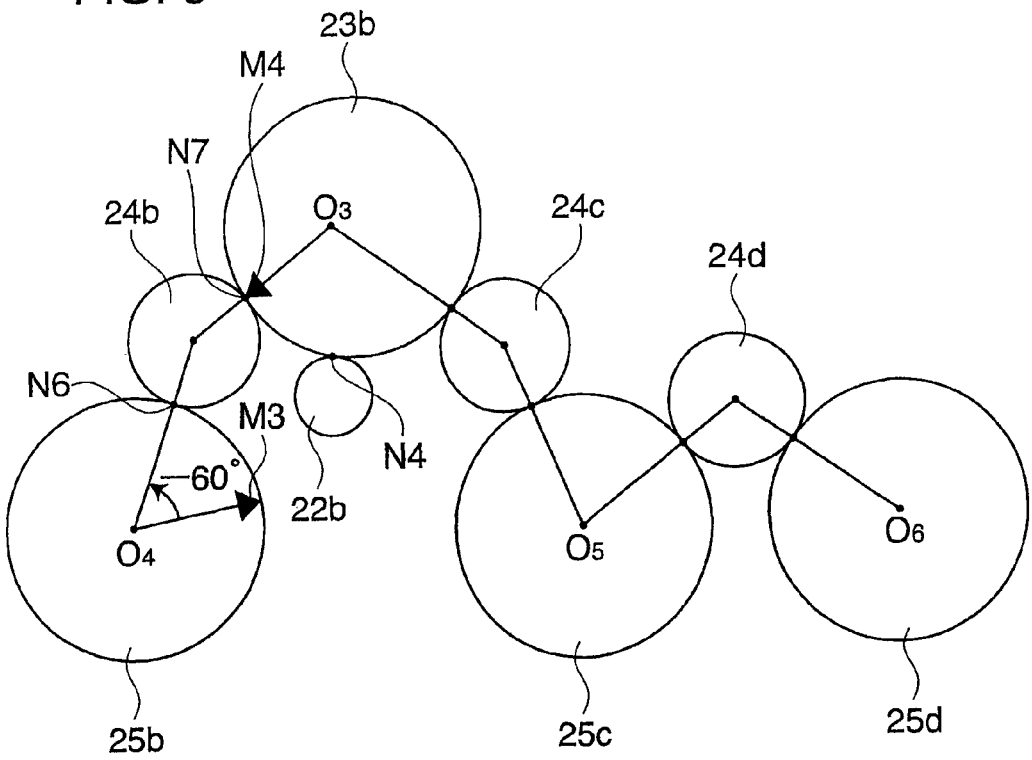
FIG. 6 is a front view illustrating an exemplary arrangement of the second example of the photosensitive-member driving mechanism according to the present invention.

Next, regarding the driven gear 25*b*, as illustrated in FIG. 6, when an index M4 on the phase control gear 23*b* is coincident with the point N7, the straight line connecting the rotational center $\mathbf{0}_4$ of the driven gear 25*b* and the point N6 and the straight line connecting the rotational center $\mathbf{0}_4$ and an index M3 form an angle of −60° therebetween.

Figure 7:
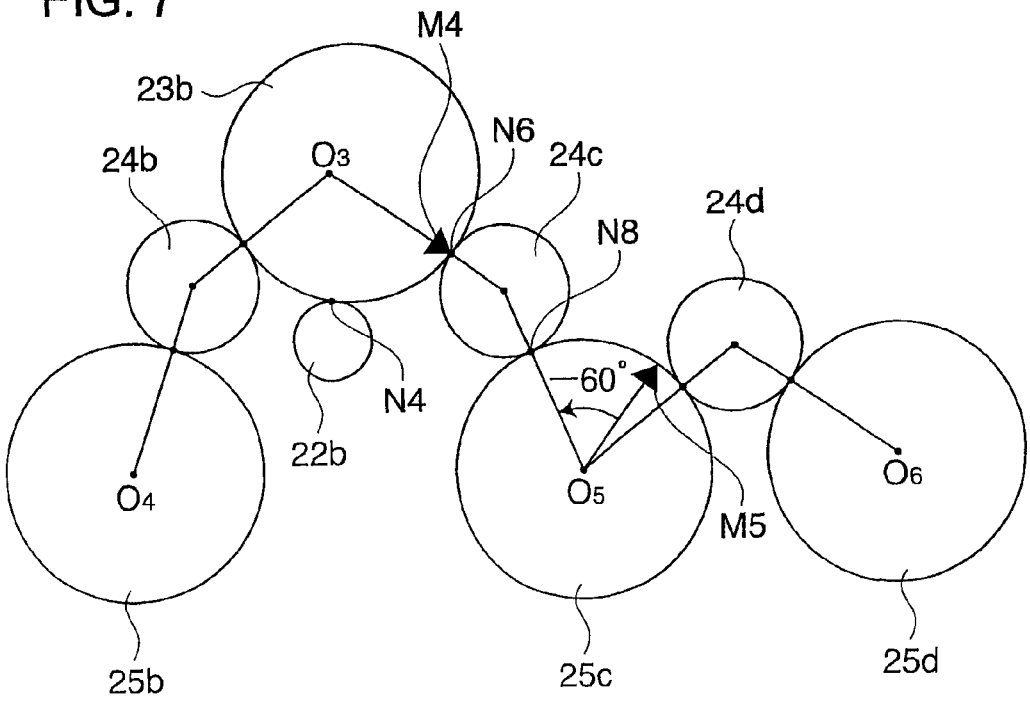
FIG. 7 is a front view illustrating an exemplary arrangement of the second example of the photosensitive-member driving mechanism according to the present invention.

Next, regarding the driven gear 25*c*, as illustrated in FIG. 7, when the index M4 on the phase control gear 23*b* is coincident with the point N6, the straight line connecting the rotational center $\mathbf{0}_5$ of the driven gear 25*c* and the point N8 and the straight line connecting the rotational center $\mathbf{0}_5$ and an index M5 form an angle of −60° therebetween.

Figure 8:
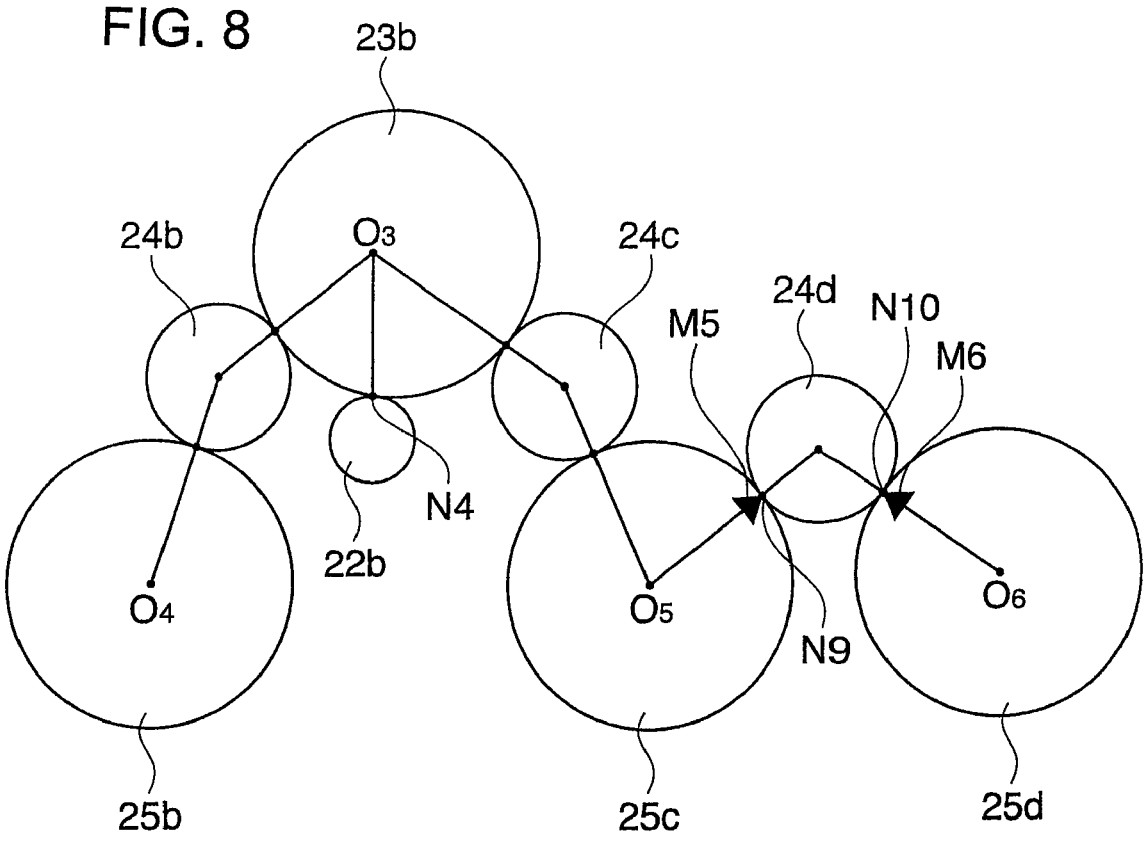
FIG. 8 is a front view illustrating an exemplary arrangement of the second example of the photosensitive-member driving mechanism according to the present invention.

Next, regarding the driven gear 25*d*, as illustrated in FIG. 8, an index M6 is set, thereon, to be coincident with the point N10, when the index MS on the driven gear 25*c* is coincident with the point N9.

By setting as described above, a state of $\theta_B-(\theta_A-\theta_X)=0°$ is realized. In this case, the following condition is satisfied. Since the variation of the angular speed of the driven gear 25*c* is 0, the variation of the angular speed of the driven gear 25*d* can be made zero.

$$\theta_B-(\theta_A-\theta_X)=0, \text{ namely } \theta_B=\theta_A-\theta_X$$

Accordingly, the following equation holds.

$$\begin{aligned}\omega_B &= (v_1/r)\cdot\{1-a\sin\theta_A+a\sin(\theta_A-\theta_X)-a\sin\theta_B\}\\ &= (v_1/r)\cdot(1-a\sin\theta_A)\\ &= \omega_A\end{aligned}$$

Namely, since $\omega_B$ equals to $\omega_A$, if the angular speed variation $\Delta\omega_A$ is 0, $\Delta\omega_B$ is also zero.

As described above, it is possible to rotate the photosensitive drums 101*a*, 101*b*, 101*c* and 101*d* at constant angular speeds which are not varied, similarly, in the second example.

THIRD EXAMPLE

In the present example, there will be described the photosensitive-member driving mechanisms which are integrally applied to the photosensitive drums 101*b* to 101*d* for forming full-colored images in the image forming apparatus 100 illustrated in FIG. 1.

Further, the photosensitive-member driving mechanism according to the first example is applied to the photosensitive drum 101*a* for forming black-colored images. In this case, the photosensitive drum 101*a* can have a diameter larger than that of the other photosensitive drums 101*b* to 101*d*.

FIGS. 9 to 13 illustrate the positional and angular relationship among the respective components of the photosensitive-member driving mechanisms according to the present example 3.

Figure 9:
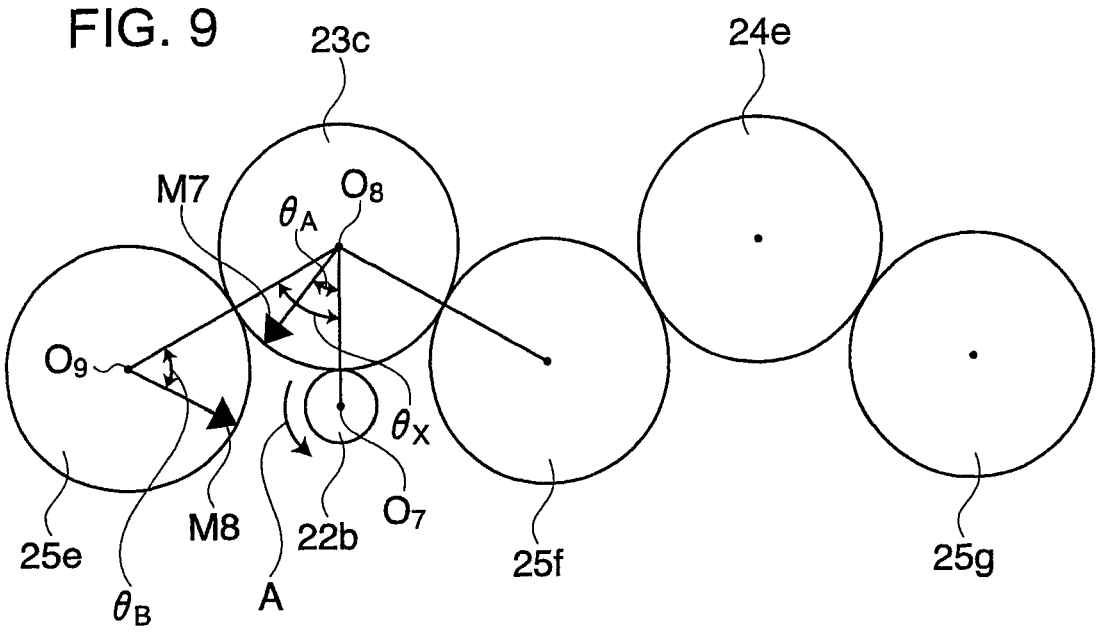
FIG. 9 is an explanation view illustrating the structure and operations of a third example of the image forming apparatus according to the present invention.

As illustrated in FIG. 9, a rotational force from the driving gear 22*b* which is driven at a constant speed in the direction of an arrow A by a motor, not illustrated, is transmitted to a phase control gear 23*c*, and the driving force is transmitted from the phase control gear 23*c* to a driven gear 25*e* and also is transmitted from the phase control gear 23*c* to a driven gear 25*f*, and then is transmitted from the driven gear 25*f* to a driven gear 25*g* through a transmission gear 24*e*. The driven gears 25*e* to 25*g* are coupled to end portions of the photosensitive drums 101*b* to 101*d* (FIG. 1), respectively. Further, the driven gears 25*e* to 25*g*, the phase control gear 23*c* and the transmission gear 24*e* are formed using the same die and have the same speed variation characteristic.

With reference to FIG. 9, the operations of the photosensitive-member driving mechanisms will be described, with respect to the relationship between the phase control gear 23*c* and the driven gear 25*e* which is representative thereof.

The following angles are set;

the angle $\theta_A$ between a first straight line connecting the center $\mathbf{0}_7$ of the driving gear and the center $\mathbf{0}_8$ of the phase control gear and a second straight line connecting the center $\mathbf{0}_8$ of the phase control gear 23*c* and an index M7 on the phase control gear 23*c*, the angle $\theta_B$ between a third straight line connecting the center $\mathbf{0}_8$ of the phase control gear 23*c* and the center $\mathbf{0}_9$ of the driven gear 25*e* and a fourth straight line connecting the center $\mathbf{0}_9$ of the driven gear 25*e* and an index M8 on the driven gear 25*e*, and the angle $\theta_X$ between the first straight line and the third straight line.

Further, in the case where there is the relationship $\theta_X=60°$ and $\theta_B-(\theta_A-\theta_X)=-60°$ or $\theta_X=-60°$ and $\theta_B-(\theta_A-\theta_X)=60°$ (the characters of "+" and "−" indicate a direction of rotation of the driven gear 25*e* and the opposite direction of rotation of the driven gear 25*e*, respectively), the angular speed variation of the driven gear 25*e* can be made zero.

Figure 10:
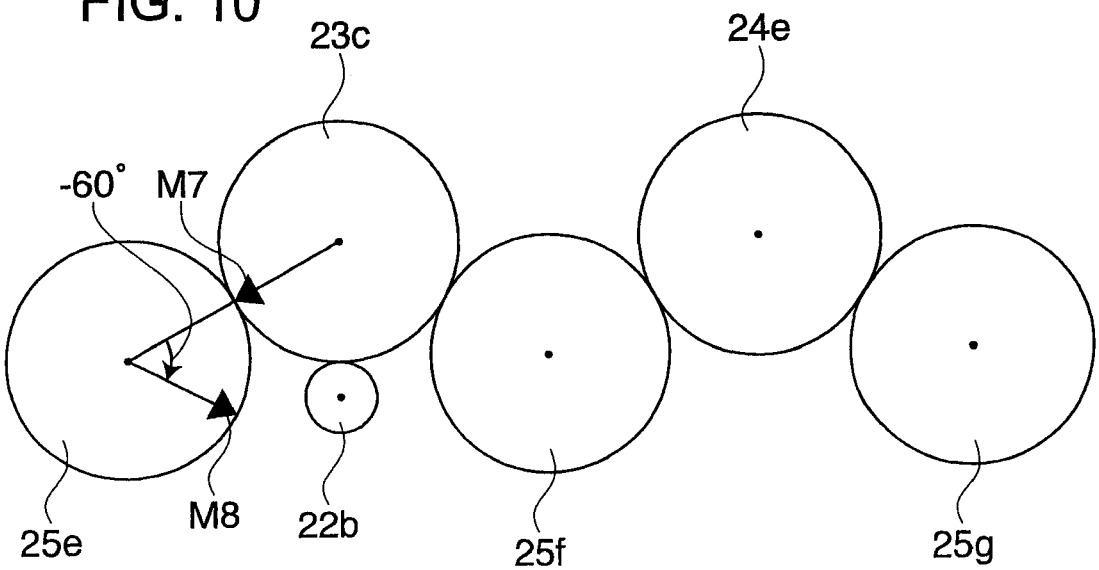
FIG. 10 is an explanation view illustrating the structure and operations of the third example of the image forming apparatus according to the present invention.

FIG. 10 concretely illustrates the condition on the phases of the phase control gear 23*c* and the driven gear 25*e*.

The index M7 on the phase control gear 23*c* is rotated from the contact point between the phase control gear 23*c* and the driven gear 22*b* by 60 degrees in the direction of the rotation of the phase control gear 23*c* to cause the index M7 on the phase control gear 23*c* to be coincident with the contact point between the phase control gear 23*c* and the driven gear 25*e* ($\theta_X=60°$) and, also, the index M8 on the driven gear 25*e* is rotated by 60° in the opposite direction of the rotation of the driven gear 25*e* (−60°).

Figure 11:
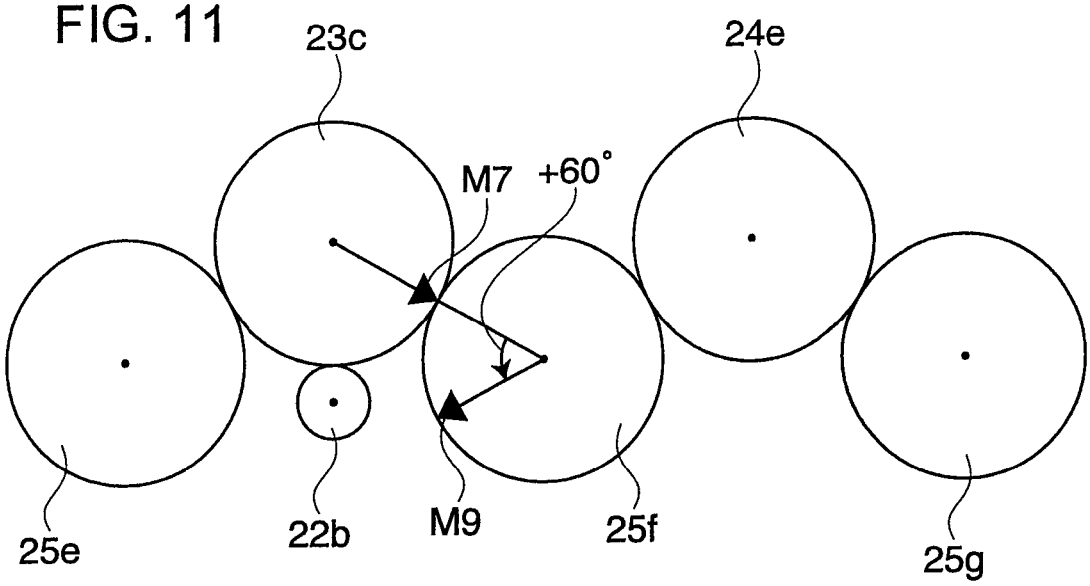
FIG. 11 is an explanation view illustrating the structure and operations of the third example of the image forming apparatus according to the present invention.

FIG. 11 concretely illustrates the condition on the phases of the phase control gear 23*c* and the driven gear 25*f*.

The index M7 on the phase control gear 23*c* is rotated from the contact point between the phase control gear 23*c* and the driven gear 22*b* by 60° in the opposite direction of the rotation of the phase control gear 23*c* ($\theta_X=-60°$) to cause the index M7 to be coincident with the contact point between the phase control gear 23*c* and the driven gear 25*f* and, also, an index M9 on the driven gear 25*f* is rotated by 60° in the direction of the rotation of the driven gear 25*f* (+60°).

Figure 12:
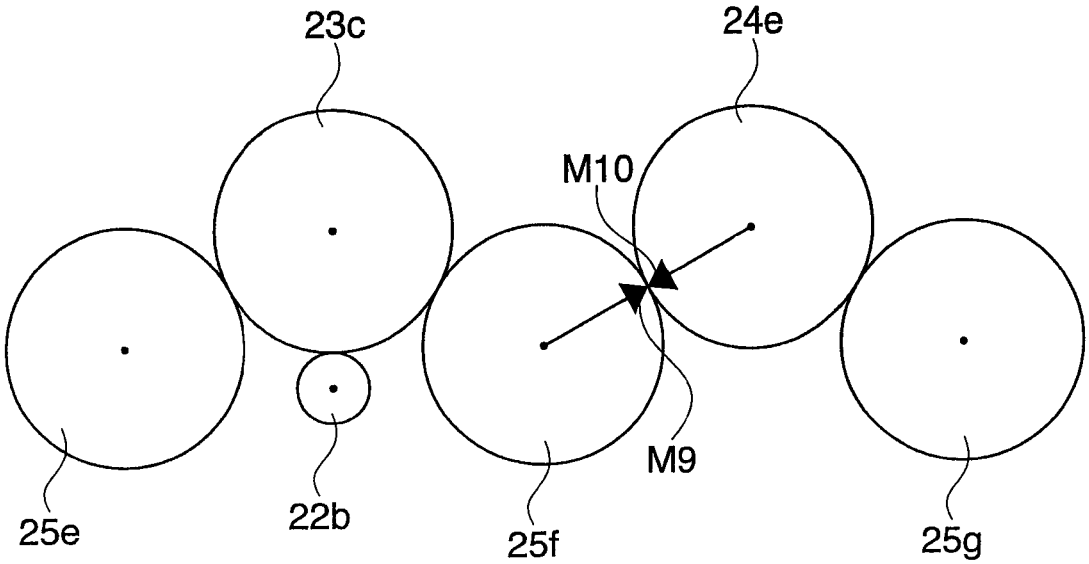
FIG. 12 is an explanation view illustrating the structure and operations of the third example of the image forming apparatus according to the present invention.
Figure 13:
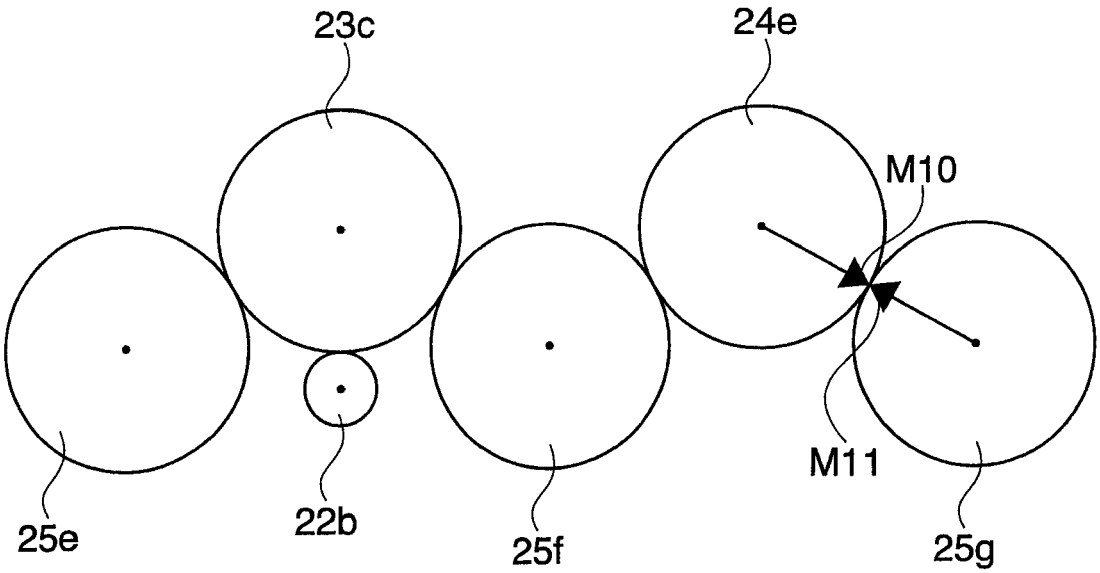
FIG. 13 is an explanation view illustrating the structure and operations of the third example of the image forming apparatus according to the present invention.

FIG. 12 and FIG. 13 illustrate the driving of the transmission gear 24*e* by the driven gear 25*f* and the driving of the driven gear 25*g*.

FIG. 12 illustrates the condition on driving the transmission gear 24*e* by the driven gear 25*f*.

At first, the driven gear 25*f* and the transmission gear 24*e* are set, such that an index M10 on the transmission gear 24*e* is coincident with the contact point between the transmission gear 24*e* and the driven gear 25*f*, when the index M9 on the driven gear 25*f* is coincident with the contact point between the driven gear 25*f* and the transmission gear 24*e*.

By setting as described above, a state of $\theta_B-(\theta_A-\theta_X)=0°$ is realized, between the driven gear 25*f* and the transmission gear 24*e*. In this case, the condition of the following equation (8) is satisfied, since the driven gear 25*f* and the transmission gear 24*e* have the same eccentricity characteristic. Since the angular speed variation ($\Delta\omega_A$) of the driven gear 25*f* is zero, the angular speed variation ($\Delta\omega_B$) of the transmission gear 24*e* can be made zero.

$$\theta_B-(\theta_A-\theta_X)=0, \text{ namely } \theta_B=\theta_A-\theta_X$$

Accordingly, the following equation holds.

$$\begin{aligned}\omega_B &= (v_1/r)\cdot\{1-a\sin\theta_A+a\sin(\theta_A-\theta_X)-a\sin\theta_B\} \quad (8)\\ &= (v_1/r)\cdot(1-a\sin\theta_A)\\ &= \omega_A\end{aligned}$$

Namely, $\omega_B$ equals to $\omega_A$ and, therefore, if the angular speed variation $\Delta\omega_A$ is zero, then $\Delta\omega_B$ is zero.

Next, FIG. 13 illustrates the condition on driving of the driven gear 25*g* by the transmission gear 24*e*.

At first, the driven gear 25*g* and the transmission gear 24*e* are set, such that the index M10 on the transmission gear 24*e* is coincident with the contact point between the transmission gear 24*e* and the driven gear 25*g*, when the index M11 on the driven gear 25*g* is coincident with the contact point between the driven gear 25*g* and the transmission gear 24*e*.

By setting as described above, a state of $\theta_B-(\theta_A-\theta_X)=0°$ is realized, between the driven gear 25*g* and the transmission gear 24*e*. In this case, the aforementioned equation (8) holds. Since the angular speed variation ($\Delta\omega_A$) of the transmission gear is zero, the angular speed variation ($\Delta\omega_B$) of the driven gear 25*g* can be made zero.

By doing as described above, it is possible to rotate the photosensitive drums 101*b* to 101*d* at constant rotation speeds which are not varied.

What is claimed is:

1. A photosensitive-member driving mechanism comprising:

a driving gear which is secured to a rotational shaft of a rotational driving power source and is rotated at a constant peripheral speed;

a driven gear secured coaxially to a rotational shaft of a cylindrical-shaped photosensitive member;

a phase control gear having the same diameter as that of the driven gear and having the same rotational speed variation characteristic as that of the driven gear; and a transmission gear, wherein the driving gear transmits a driving force to the driven gear through the phase control gear and the transmission gear.

2. The photosensitive-member driving mechanism according to claim 1, wherein the transmission gear is adapted to transmit a peripheral speed of the phase control gear to the driven gear such that the driven gear is rotated at a constant angular speed.

3. The photosensitive-member driving mechanism according to claim 1, wherein the transmission gear is detachably supported by a rotational shaft.

4. The photosensitive-member driving mechanism according to claim 1, wherein $\theta_X=60°$ and $\theta_B-(\theta_A-\theta_X)=-60°$ or $\theta_X=-60°$ and $\theta_B-(\theta_A-\theta_X)=60°$ (the characters of "+" and "−" indicate a direction of rotation of the driven gear and the opposite direction of rotation of the driven gear, respectively), when the driven gear and the phase control gear are eccentric gears, and the driven gear and the phase control gear are provided with indexes indicative of the same rotational phase of both the gears, a first straight line connecting the center of the driving gear and the center of the phase control gear and a second straight line connecting the center of the phase control gear and the index on the phase control gear forming an angle of $\theta_A$ therebetween, a third straight line connecting the center of the phase control gear and the center of the transmission gear and the first straight line forming an angle of $\theta_x$ therebetween, a fourth straight line connecting the center of the transmission gear and the center of the driven gear and a fifth straight line connecting the center of the driven gear and the index on the driven gear forming an angle of $\theta_B$ therebetween.

5. The photosensitive-member driving mechanism according to claim 4, wherein the indexes are molded integrally with the driven gear and the phase control gear.

6. A photosensitive-member driving mechanism comprising:

a driving gear which is secured to a rotational shaft of a rotational driving power source and is rotated at a constant peripheral speed; driven gears being secured coaxially to respective rotational shafts of plural cylindrical-shaped photosensitive members and having the same diameter and the same rotational variation characteristic;

a single phase control gear having the same diameter as that of the driven gears and having the same rotational speed variation characteristic as that of the driven gears; and plural transmission gears, wherein the driving gear transmits a driving force to the respective driven gears through the phase control gear and one of the transmission gears.

7. A photosensitive-member driving mechanism comprising:

a first mechanism comprising a first driving gear which is secured to a rotational shaft of a rotational driving power source and is rotated at a constant peripheral speed, a first driven gear secured coaxially to a rotational shaft of a cylindrical-shaped photosensitive member, a first phase control gear having the same diameter as that of the first driven gear and having the same rotational speed variation characteristic as that of the first driven gear, and a first transmission gear, the first mechanism being adapted to transmit a driving force from the first driving gear to the first driven gear through the first phase control gear and the first transmission gear; and a second mechanism comprising a second driving gear which is secured to a rotational shaft of a rotational driving power source and is rotated at a constant peripheral speed, second driven gears secured coaxially to respective rotational shafts of plural cylindrical-shaped photosensitive members and having the same diameter and the same rotational variation characteristic, a single second phase control gear having the same diameter as that of the second driven gears and having the same rotational speed variation characteristic as that of the second driven gears, and plural second transmission gears, the second mechanism being adapted to transmit a driving force from the second driving gear to the respective second driven gears through the second phase control gear and the second transmission gears.

8. A photosensitive-member driving mechanism comprising;

a driving gear which is secured to a rotational shaft of a rotational driving power source and is rotated at a constant peripheral speed, a driven gear secured coaxially to a rotational shaft of a cylindrical-shaped photosensitive member; and a phase control gear having the same diameter as that of the driven gear and having the same rotational speed variation characteristic as that of the driven gear, wherein the driving gear transmits a driving force to the driven gear through the phase control gear.

9. A photosensitive-member driving mechanism comprising;

a driving gear which is secured to a rotational shaft of a rotational driving power source and is rotated at a constant peripheral speed;

a plurality of driven gears secured coaxially to respective rotational shafts of cylindrical-shaped photosensitive members and having the same diameter and the same rotational variation characteristic; and a single phase control gear having the same diameter as that of the driven gears and having the same rotational speed variation characteristic as that of the driven gears, wherein the driving gear transmits a driving force to the respective plural driven gears through the phase control gear.

10. The photosensitive-member driving mechanism according to claim 8, wherein $\theta_X=60°$ and $\theta_{B-(\theta A}-\theta_X)=-60°$ or $\theta_X=-60°$ and $\theta_B-(\theta_A-\theta_X)=60°$ (the characters of "+" and "−" indicate a direction of rotation of the driven gear and the opposite direction of rotation of the driven gear, respectively), when the driven gear and the phase control gear are eccentric gears, and the driven gear and the phase control gear are provided with indexes indicative of the same rotational phase of both the gears, a first straight line connecting the center of the driving gear and the center of the phase control gear and a second straight line connecting the center of the phase control gear and the index on the phase control gear forming an angle of $\theta_A$ therebetween, a third straight line connecting the center of the phase control gear and the center of the driven gear and the first straight line forming an angle of $\theta_X$ therebetween, a fourth straight line connecting the center of the driven gear and the index on the driven gear and the third straight line forming an angle of $\theta_B$ therebetween.

11. The photosensitive-member driving mechanism according to claim 8, wherein the driven gear comprises a first and second driven gears, and there is provided a transmission gear for transmitting the driving force from the first driven gear to the second driven gear.

12. The photosensitive-member driving mechanism according to claim 11, wherein the transmission gear is a gear having the same eccentricity characteristic as that of each driven gear.

13. The photosensitive-member driving mechanism according to claim 12, wherein the rotational phase of the transmission gear is set, such that indexes on the first driven gear and the transmission gear are coincident with the contact point between the first driven gear and the transmission gear, and indexes on the second driven gear and the transmission gear are coincident with the contact point between the second driven gear and the transmission gear.

14. The photosensitive-member driving mechanism according to claim 9, wherein $\theta_X=60°$ and $\theta_B-(\theta_A-\theta_X)=-60°$ or $\theta_X=-60°$ and $\theta_B-(\theta_A-\theta_X)=60°$ (the characters of "+" and "−" indicate a direction of rotation of the driven gear and the opposite direction of rotation of the driven gear, respectively), when the driven gear and the phase control gear are eccentric gears, and the driven gear and the phase control gear are provided with indexes indicative of the same rotational phase of both the gears, a first straight line connecting the center of the driving gear and the center of the phase control gear and a second straight line connecting the center of the phase control gear and the index on the phase control gear forming an angle of $\theta_A$ therebetween, a third straight line connecting the center of the phase control gear and the center of the driven gear and the first straight line forming an angle of $\theta_X$ therebetween, a fourth straight line connecting the center of the driven gear and the index on the driven gear and the third straight line forming an angle of $\theta_B$ therebetween.

15. The photosensitive-member driving mechanism according to claim 9, wherein the driven gear comprises a first and second driven gears, and there is provided a transmission gear for transmitting the driving force from the first driven gear to the second driven gear.

16. The photosensitive-member driving mechanism according to claim 15, wherein the transmission gear is a gear having the same eccentricity characteristic as that of each driven gear.

17. The photosensitive-member driving mechanism according to claim 16, wherein the rotational phase of the transmission gear is set, such that indexes on the first driven gear and the transmission gear are coincident with the contact point between the first driven gear and the transmission gear, and indexes on the second driven gear and the transmission gear are coincident with the contact point between the second driven gear and the transmission gear.

* * * * *